US005472533A

United States Patent [19]

Herbage et al.

[11] Patent Number: 5,472,533

[45] Date of Patent: Dec. 5, 1995

[54] SPECTRALLY BALANCED INFRARED FLARE PYROTECHNIC COMPOSITION

[75] Inventors: David W. Herbage, Jackson; Stan L. Salvesen, Collierville, both of Tenn.

[73] Assignee: Alliant Techsystems Inc., Hopkins, Minn.

[21] Appl. No.: 310,856

[22] Filed: Sep. 22, 1994

[51] Int. Cl.[6] ..... C06B 43/00; C06B 47/10

[52] U.S. Cl. ..... 149/22; 149/41; 149/61

[58] Field of Search ..... 149/22, 37, 41, 149/61; 102/336

[56] References Cited

U.S. PATENT DOCUMENTS 3,784,419 1/1974 Baumann et al. ..... 149/2
5,291,818 3/1994 Bannasch ..... 89/1.11
5,315,125 5/1994 Bannasch ..... 89/1.11
5,317,163 5/1994 Obkircher ..... 250/495.1
5,343,794 9/1994 Andreotti et al. ..... 89/1.11

*Primary Examiner*—Donald P. Walsh
*Assistant Examiner*—Anthony R. Chi
*Attorney, Agent, or Firm*—Vidas, Arrett & Steinkraus

[57] ABSTRACT

A combination of a first and a second composition provide an adjustable spectrally balanced infrared flare usable to decoy missiles. The first composition includes boron, aluminum, ammonium perchlorate, potassium nitrate and Viton® A fluoroelastomer. The second composition includes magnesium, polytetrafluoroethylene and Viton® A fluoroelastomer. Adjusting the ratios between the compositions matches any particular aircraft's spectral signature.

7 Claims, 1 Drawing Sheet

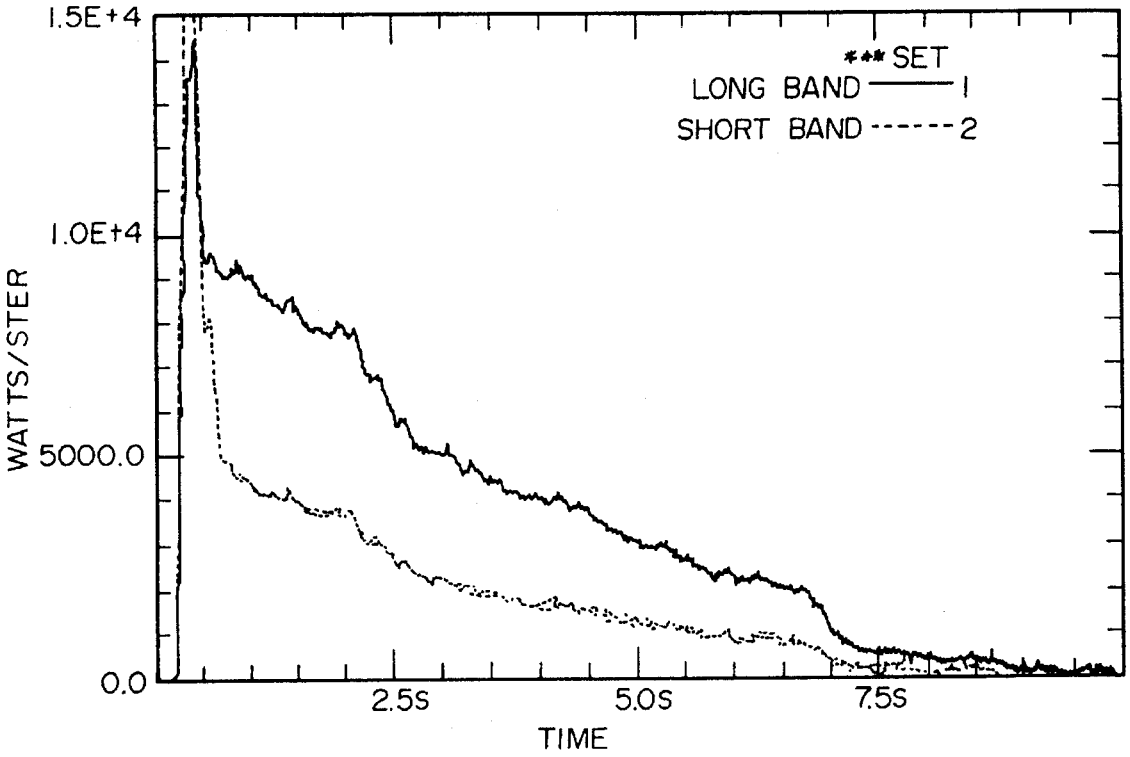
1.5E+4
1.0E+4
5000.0
0.0
WATTS/STER
2.5s
5.0s
7.5s
TIME
*** SET
LONG BAND 1
SHORT BAND 2

SPECTRALLY BALANCED INFRARED FLARE PYROTECHNIC COMPOSITION

BACKGROUND OF THE INVENTION

1. Field of the Invention

This invention relates to a composition usable in an infrared decoy flare to decoy advanced "two color" discriminating missiles.

2. Description of the Related Art

Decoys in the radar and infrared bands are used by aircraft to protect against approaching missiles. Devices are known, for instance, for aircraft to dispense chaff and IR flares. This chaff is intended to act as decoy for radar and/or increase ground clutter at the same time. However, modern pulse-doppler radar can recognize such decoys, especially in the lookdown/shootdown mode. This is particularly true because simple decoys, in contrast to true targets, do not exhibit a corresponding doppler shift in the radar band. A second problem is caused by the fact that prior infrared flares as point source Magnesium/PTFE flares either exhibit an entirely inappropriate adaptation of the aircraft's IR radiation and, moreover, radiate excessively in the UV band, or when they function as area flares on the basis of red phosphorus, they can not only be recognized as such because of the absence of independent motion, but because they do not emit their IR radiation until after they are beyond the sighting window of the IR searchhead which is locked onto the true target. In addition, flares will also be ineffective against imaging searchheads expected to be available in the future because such decoys, in contrast to true targets, exhibit no contours or edges in the low-frequency range.

An aircraft able to recognize the illumination of a hostile fighter through its lookdown/shootdown aircraft radar, nevertheless cannot know whether the enemy is employing missiles with a passive IR searchhead and/or with a passive radar searchhead, which uses the target's reflection in the illumination radar as target information.

A flying decoy is disclosed in U.S. Pat. No. 3,866,226 as launched from an aircraft, and as having a streamlined body and a radar-reflection amplifying device as well as an engine. However that decoy has not proven to be successful against weapons with an IR searchhead or with a combined infrared and radar searchhead.

It is well-known to defend airborne objects emitting an infrared radiation against missiles equipped with infrared seeker heads, in that upon detection of the approach of a missile one or more pyrotechnic fake target clouds are launched in succession by means of droppable bodies in the air space adjacent the object, the clouds guiding the infrared seeker head of the missile from the object and towards themselves. For example, reference is made to European Patent No. 0 240 819 wherein droppable bodies generating fake targets are placed and ignited in such a manner at specified times in predetermined spatial regions that the generated fake targets lie on a deflection curve at specified intervals in time and space and are to be steered towards in such a manner in succession by the missile that its flight path passes over in the deflection curve and finally in the direction of deflection.

The fake target clouds may comprise burning phosphorus flares, such as plates or strips which are coated with red phosphorus and which are ejected from the droppable body at a predetermined height at the desired point and in so doing are ignited.

However, the goal of the latest development in infrared seeker heads is to make the seeker heads "intelligent" and thus to make them immune to conventional infrared fake targets, i.e., to design them in such a manner that they respond to the object signature, in particular the aircraft signature.

A method to eliminate false targets consists of a frequency analysis by means of the seeker head, which can distinguish between the radiation characteristics of the infrared radiators (for example aircraft engines) of the target that exhibit a comparatively low temperature and the radiation characteristics of a hot fake target cloud. Thus, in summary the known infrared fake target clouds are not in a position to defend an object against missiles equipped with intelligent seeker heads.

IR decoy flares are used on many military aircraft to protect against attack by heat seeking missiles. Flares which are currently in use are made from a solid pyrotechnic composition of magnesium, polytetrafluoroethylene (PTFE) and VITON® brand fluoroelastomer copolymers or similar synthetic rubber binders. These are commonly called MTV flares and are ejected from an aircraft and simultaneously ignited by the action of a pyrotechnic squib. The burning MTV emits IR radiation that is essentially a spectral continuum attenuated by atmospheric absorption. It is intended that the falling flare will cause a missile seeker head to turn away from the target aircraft. The MTV flares are quite effective against older type missiles that seek heat in a single IR band.

However, modern missiles employ counter-counter measures (CCM). Their more refined seeker heads use two or more spectral bands in an attempt to distinguish between the flare and the aircraft. Both IR and ultraviolet (UV) band may be used. Trajectory discrimination may also be used by some seeker heads and the physical size of the heat source will be become more important in the future as imaging seekers are developed.

Alternatives to MTV flares have therefore been considered in recent years and in particular flares that use the combustion of pyrophoric liquids to generate an intense heat source have been shown to be particularly effective. These are too large and cumbersome to be practical. A pyrophoric flare is disclosed in U.S. Pat. No. 5,136,950.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. §1.56(a) exists.

SUMMARY OF THE INVENTION

The invention provides a composition which may be used in missile decoys. The composition is composed of two separate formulations which each supply differing levels of infrared signature energies. The percentage ratio between the first and second formulations may be adjusted up or down to vary the infrared spectral output of the decoy flare to match the aircraft to be protected.

BRIEF DESCRIPTION OF THE DRAWINGS

A detailed description of the invention is hereafter described with specific reference being made to the drawing in which:

FIG. 1 is a two coordinate graph showing the radiant intensity in watts per steradian as a function of time, in seconds, for a decoy flare made in accordance with the invention.

DESCRIPTION OF THE PREFERRED EMBODIMENTS

The pyrotechnic composition of the invention consists of two basic compositions. The first of these compositions produces a strong signature in the infrared band 3 (4.0μ to 5.0μ) and weak signatures in band 1 (2.0μ to 3.0μ) and band 2 (3.0μ to 4.0μ). The second of these compositions produces a very strong signature in the infrared band 1 (2.0μ to 3.0μ), a lesser signature in the infrared band 2 (3.0μ to 4.0μ), and an even lesser (but still significant) signature in the infrared band 3 (4.0μ to 5.0μ).

The second composition is similar to currently used infrared flare compounds and adds band 1 and band 2 energy to the total inventive composition. The first composition produces a strong band 3 signature. The percentage ratio of the first composition to the second composition may be adjusted up or down to vary the infrared spectral output of the decoy flare to match the aircraft to be protected. The use of this composition and its adjustability to a particular aircraft's signature is a significant advancement over the prior art.

The useful range of the composition's ratios within the formula are:

| | |
|---|---|
| First Composition | 40% to 100% |
| Second Composition | 60% to 0% |

The formulation for the first composition is:

| | | |
|---|---|---|
| Boron | 4% to 9% | |
| Aluminum | 8% to 16% | |
| Hexamine* | 7% to 13% | |
| Potassium Nitrate | 5% to 11% | |
| Ammonium Perchlorate | 44% to 58% | 44% to 70% |
| Viton ® A fluoroelastomer copolymer | 10% to 20% | 0% |
| Synthetic rubber binder | 0% | 3% to 10% |

*Hexamine or its derivatives such as RDX, HMX, etc. may be used.

When reference is made herein to "hexamine", it is understood to include hexamine and its derivatives.

The formulation of the second composition is:

| | | |
|---|---|---|
| Magnesium | 45% to 70% | |
| PTFE (polyethylenetetrafluoroethylene) | 25% to 45% | 25% to 50% |
| Viton ® A fluoroelastomer copolymer | 10% to 20% | 0% |
| Synthetic rubber binder | 0% | 3% to 10% |

As shown by the above tables, a synthetic rubber binder may be used instead of a fluoroelastomer copolymer as the binder. Such synthetic rubbers may include synthetic acrylic rubbers such as Hycar, available from Zeon Chemical Co. under its tradename Hy-Temp 4451 CG; polyisobutylenes and equivalents to these rubbers which function as binders. The tables show that the use of a synthetic rubber binder will cause slight adjustments in the percentages of PTFE and ammonium perchlorate.

An example of a combined formulation which will meet a specific signature for a current aircraft is:

| | |
|---|---|
| Boron | 4.125% |
| Aluminum | 9.9% |
| Magnesium | 10.15% |
| Hexamine | 8.25% |
| Ammonium Perchlorate | 42.075% |
| Potassium Nitrate | 6.6% |
| PTFE (polyethylenetetrafluoroethylene) | 4.9% |
| Viton ® A fluoroelastomer copolymer | 14% |

This composition is based on 82.5% of the first composition and 17.5% of the second composition. The Example of FIG. 1 shows the radiant intensity as a function of time for this composition. The long band includes bands 2 and 3. The short band includes band 1. Note that the initial spike is due in part to ignition materials. The spectral ratio of the above-utilized composition is:

*(Infrared Band 2 Energy+Infrared Band 3 Energy)/Infrared Band 1 Energy*=~1.8

The spectral ratio of standard infrared flare compositions calculated in the above manner is approximately 0.5.

Viton® is a fluoroelastomer based on a copolymer of vinylidene fluoride and hexafluoropropylene of E.I. dupont de Nemours & Co., Inc. of Wilmington, Del., USA. Viton® A contains about 65% fluorine, has a specific gravity of 1.85, Mooney viscosity of 35–45 and has a relatively low molecular weight. Viton® A is identical to Viton® VT-R-5883 which meets Naval Ordnance Systems Command, Department of the Navy Specification WS-7682. The bulk of fluorocarbon elastomers are copolymers of vinylidene fluoride and hexafluoropropylene combined in an approximately four to one molar ratio by a free-radical initiated emulsion polymerization process. An equivalent to Viton® A is Fluorel® Fluoroelastomer 2175 from Minnesota Mining & Manufacturing Co. (3M) of Minnesota.

Reference to Viton® A brand fluoroelastomer herein is meant to include all equivalents to that fluoroelastomer. As an alternative to a fluoroelastomer copolymer, a synthetic rubber binder may be used as the binder. Use of the term ∓synthetic rubber binder" herein includes synthetic acrylic rubbers, polyisobutylenes and equivalents known to those skilled in this art as a substitute that will function as a binder. It should be understood that a combination of a fluoroelastomer and a synthetic rubber binder is possible, and that such combination is within the scope of this invention.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

This completes the description of the preferred and alternate embodiments of the invention. Those skilled in the art may recognize other equivalents to the specific embodiment described herein which equivalents are intended to be encompassed by the claims attached hereto.

What is claimed is:

1. A pyrotechnic composition comprising on a weight total percent basis:

a) from about 40 to about 100% of a first formulation and from about 60 to about 0% of a second formulation;

b) said first formulation comprising from about 4 to about 9% boron, from about 8 to about 16% aluminum, from about 7 to about 13% hexamine, a binder in an amount of about 3 to about 20%, said binder being selected from the group consisting of a fluoroelastomer copolymer and a synthetic rubber binder, and from about 44 to about 70% ammonium perchlorate; and c) said second formulation comprising from about 45 to about 70% magnesium, from about 25 to about 50% polytetrafluoroethylene and a binder in an amount of about 3 to about 20%, said binder being selected from the group consisting of a fluoroelastomer copolymer and a synthetic rubber binder.

2. A pyrotechnic composition comprising on a weight percent basis about 4% boron, about 10% aluminum, about 10% magnesium, about 8% hexamine, about 42% ammonium perchlorate, about 7% potassium nitrate, about 5% polytetrafluoroethylene and about 14% fluoroelastomer.

3. A pyrotechnic composition comprising on a weight total percent basis:

a) from about 40 to about 100% of a first formulation and from about 60 to about 0% of a second formulation;

b) said first formulation comprising from about 4 to about 9% boron, from about 8 to about 16% aluminum, from about 7 to about 13% hexamine, a binder in an amount of about 3 to about 20%, said binder being selected from the group consisting of a fluoroelastomer copolymer and a synthetic rubber binder, and from about 44 to about 70% ammonium perchlorate; and c) said second formulation comprising from about 45 to about 70% magnesium, from about 25 to about 50% polytetrafluoroethylene and a binder in an amount of about 3 to about 20%, said binder being selected from the group consisting of a fluoroelastomer copolymer and a synthetic rubber binder, wherein said first formulation binder includes a fluoroelastomer copolymer in the amount of between about 10 to about 20% and said ammonium perchlorate is between about 44 to about 58%.

4. The pyrotechnic composition of claim 3 wherein said second formulation binder includes a fluoroelastomer copolymer in the amount of between about 10 to about 20% and said PTFE is between about 25 to about 45%.

5. A pyrotechnic composition comprising on a weight total percent basis:

a) from about 40 to about 100% of a first formulation and from about 60 to about 0% of a second formulation;

b) said first formulation comprising from about 4 to about 9% boron, from about 8 to about 16% aluminum, from about 7 to about 1.3% hexamine, a binder in an amount of about 3 to about 20%, said binder being selected from the group consisting of a fluoroelastomer copolymer and a synthetic rubber binder, and from about 44 to about 70% ammonium perchlorate; and c) said second formulation comprising from about 45 to about 70% magnesium, from about 25 to about 50% polytetrafluoroethylene and a binder in an amount of about 3 to about 20%, said binder being selected from the group consisting of a fluoroelastomer copolymer and a synthetic rubber binder, wherein said first formulation binder includes a synthetic rubber binder in the amount of between about 3 to about 10% and said ammonium perchlorate is between about 44 to about 70%.

6. A pyrotechnic composition comprising on a weight total percent basis:

a) from about 40 to about 100% of a first formulation and from about 60 to about 0% of a second formulation;

b) said first formulation comprising from about 4 to about 9% boron, from about 8 to about 16% aluminum, from about 7 to about 13% hexamine, a binder in an amount of about 3 to about 20%, said binder being selected from the group consisting of a fluoroelastomer copolymer and a synthetic rubber binder, and from about 44 to about 70% ammonium perchlorate; and c) said second formulation comprising from about 45 to about 70% magnesium, from about 25 to about 50% polytetrafluoroethylene and a binder in an amount of about 3 to about 20%, said binder being selected from the group consisting of a fluoroelastomer copolymer and a synthetic rubber binder, wherein said second formulation binder includes a synthetic rubber binder in the amount of between about 3 to about 10% and said polytetrafluoroethylene is between about 25 to about 50%.

7. A method for producing a decoy flare composition which when burned produces an infrared signature which resembles an infrared signature of a selected aircraft comprising the steps of:

(a) determining the infrared signature of the aircraft to be protected by a decoy flare;

(b) obtaining a first formulation comprising from about 4 to about 9% boron, from about 8 to about 16% aluminum, from about 7 to about 13% hexamine, from about 44 to about 70% ammonium perchlorate and a binder in an amount of about 3 to about 20%, said binder being selected from the group consisting of a fluoroelastomer copolymer and a synthetic rubber binder; obtaining a second formulation comprising from about 45 to about 70% magnesium, from about 25 to about 50% polytetrafluoroethylene and a binder in an amount of about 3 to about 20%, said binder being selected from the group consisting of a fluoroelastomer copolymer and a synthetic rubber binder;

(c) determining the percentage ratio of said first composition to said second composition which will produce a matching spectral output to the aircraft infrared signature; and (d) compounding a decoy flare composition accordingly.

* * * * *